US005178115A

United States Patent [19]

Daly

[11] Patent Number: 5,178,115

[45] Date of Patent: Jan. 12, 1993

[54] FUEL RAIL ASSEMBLY HAVING SELF-CONTAINED ELECTRONICS

[75] Inventor: Paul D. Daly, Troy, Mich.

[73] Assignee: Siemens Automotive L.P., Auburn Hills, Mich.

[21] Appl. No.: 816,776

[22] Filed: Jan. 2, 1992

Related U.S. Application Data

[60] Continuation of Ser. No. 740,683, Aug. 6, 1991, abandoned, which is a division of Ser. No. 653,598, Feb. 11, 1991, abandoned, which is a continuation-in-part of Ser. No. 653,598, Feb. 11, 1991, abandoned.

[51] Int. Cl.[5] ..... F02M 55/02

[52] U.S. Cl. ..... 123/470; 123/456; 123/468; 239/600

[58] Field of Search ..... 123/456, 468, 469, 470, 123/472, 531; 239/600, 550, 559, 566, 583, 584, 585, 586

[56] References Cited

U.S. PATENT DOCUMENTS

| | | | |
|---|---|---|---|
| 3,009,655 | 11/1961 | Palmer | 239/600 |
| 3,273,805 | 9/1966 | Hall | 239/600 |
| 4,365,758 | 12/1982 | Schaming | 239/600 |
| 4,732,327 | 3/1988 | Aichele et al. | 239/600 |
| 4,836,246 | 6/1989 | Lemp | 137/561 A |
| 4,844,036 | 7/1989 | Bassler et al. | 123/470 |
| 4,934,329 | 6/1990 | Lear et al. | 123/531 |
| 4,950,171 | 8/1990 | Muzslay | 439/76 |
| 5,030,116 | 7/1991 | Sakai et al. | 123/470 |
| 5,086,743 | 2/1992 | Hickey | 123/468 |

*Primary Examiner*—Tony M. Argenbright
*Assistant Examiner*—Thomas N. Moulis
*Attorney, Agent, or Firm*—George L. Boller; Russel C. Wells

[57] ABSTRACT

A number of fuel injectors are mounted on an elongated carrier that is inserted endwise into an open end of an elongated hole in a member such as a tube or an engine manifold. The fuel injectors' nozzles are received in sealed manner in holes extending through the wall of said member. A keeper also inserted endwise through the elongated hole in the member keeps the carrier in place. In one embodiment, electrical lead wires extend from the fuel injectors along the carrier to a connector on the exterior to provide for the fuel rail assembly to be electrically connected by a wiring harness to the engine management computer. In another, the injectors are connected to the connector by means of an electronic circuit board assembly that is mounted on the carrier. The electronic circuit board assembly contains circuitry that is programmed to secure the proper dynamic calibration of the injectors over their entire dynamic operating range.

17 Claims, 6 Drawing Sheets

FUEL RAIL ASSEMBLY HAVING SELF-CONTAINED ELECTRONICS

REFERENCE TO A RELATED APPLICATION

This application is a continuation of Ser. No. 07/740,683 filed Aug. 6, 1991, which is a division and a continuation-in-part of Ser. No. 07/653,598 filed Feb. 11, 1991, both now abandoned.

FIELD OF THE INVENTION

This invention relates to fuel rails for internal combustion engines.

BACKGROUND AND SUMMARY OF THE INVENTION

Conventional fuel rails for fuel-injected internal combustion engines comprise sockets which are spaced apart along the fuel rail's length and into which the fuel injectors are inserted. The fuel injectors are retained in fluid-tight relation to the fuel rail by suitable sealing and retention means. The typical fuel injector has an elongated shape and is customarily arranged on the fuel rail such that the long dimension of the injector is transverse to the long dimension of the fuel rail. As a consequence of this arrangement, the envelope that is occupied by the fuel rail assembly in the engine compartment of an automotive vehicle will have an extent transverse to the fuel rail that is determined by the long dimension of the fuel injector. Accordingly, a reduction in the extent to which a fuel injector projects transversely of the fuel rail will be beneficial in reducing the envelope occupied by the fuel rail assembly, and this benefit will accrue to the advantage of automotive vehicle designers insofar as styling and packaging considerations are concerned.

The patent application that has been referenced above relates to a fuel rail that contains a novel fuel injector configuration which allows for certain reductions in the size of the envelope that is occupied by the fuel rail assembly on an internal combustion engine, particularly reductions in the extent to which the fuel injectors project transversely of the fuel rail. More specifically, the fuel rail may comprise a circular cylindrical-walled tube within which the fuel injectors are essentially entirely disposed so that the transverse dimension of the fuel rail assembly at the location of a fuel injector is essentially that of the O.D. of the tube. The fuel injectors are mounted on a carrier to form a sub-assembly that is assembled into the tube by endwise insertion. The electrical leads for the fuel injectors run along the carrier to a receptacle that is at one lengthwise end of the completed fuel rail assembly. The injectors' tip ends from which liquid fuel is injected are seated in a sealed manner in holes in the sidewall of the tube.

The fuel injectors themselves are unique. Rather than having a solenoid, an armature, a needle, and a seat coaxially arranged along the length of the fuel injector, as in conventional fuel injectors, the fuel injector of the referenced application has a magnetic circuit that encircles a spherical valve element. This sphere is resiliently urged by a cantilever spring blade toward closure of a hole that is circumscribed by a frusto-conical seat. The sphere-encircling magnetic circuit may be considered to comprise four sides. The armature and the solenoid are disposed at two opposite sides. The stator has a U-shape whose base passes through the solenoid and whose legs form the remaining two sides. The armature is a bar of magnetically permeable material whose midpoint acts on the sphere. When the solenoid is not energized, working gaps exist between the ends of the bar and the distal ends of the stator's legs, and when the solenoid is energized, the magnetic flux attracts the bar to reduce these working gaps. As a result, the bar pushes the sphere out of concentricity with the seat to cause the hole to open and pass for injection from the injector's tip end the pressurized liquid fuel that has been supplied to the injector via the interior of the fuel rail tube. When the solenoid is de-energized, the cantilever spring pushes the sphere back to concentricity with the seat, and the resultant hole closure terminates the injection. The fuel injector is well-suited for miniaturization to fit within a fuel rail and is an efficient and economical use of parts and materials.

The invention of this division and continuation-in-part patent application relates to features of the fuel rail assembly and its method of manufacture. The fuel rail assembly comprises an elongated carrier that contains spaced apart cavities in which the fuel injectors are respectively disposed. The combination of carrier and fuel injectors forms a sub-assembly which is disposed internally of a tube by inserting the sub-assembly endwise into the tube. The tube may be either a separate tube that is itself ultimately attached to the engine, or a hole in the engine manifold. The carrier also contains electric circuitry for operating the fuel injectors, and includes electrical terminals for making electrical circuit connection to a remotely located engine management computer which delivers principal command signals to the fuel rail assembly for operating the fuel injectors. The carrier-mounted electric circuitry also includes its own microprocessor, a calibration PROM (programmable read only memory, fuel injector drivers, and related auxiliary electronic circuit devices. These further electronic circuit components provide for the fuel rail assembly to be electronically calibrated for dynamic flow throughout the entire dynamic operating range.

The inclusion of such electronic circuitry in the fuel rail assembly confers a number of substantial benefits. Electronic calibration provides improved accuracy because electronic devices can be calibrated with greater precision than can mechanical devices, and because calibration can be conducted for the entire dynamic range by use of a correction table, as opposed to the single fixed test point mechanical calibration that has been the practice up to now. By having a broader range of calibration, it is possible that the fabrication of mechanical parts can be conducted with less strict tolerances, thereby saving on mechanical fabrication costs, while the fuel rail assembly will ultimately obtain better accuracy over the dynamic range by calibrating the self-contained electronics. The usual ability for electronic calibration to be performed more rapidly than mechanical calibration will save on the time required for making a fuel rail assembly. Hence, a given calibration machine will be able to process more assemblies per unit time, and for mass-production purposes, a fewer number of such machines, and hence a lower capital investment, will be the result. By having the calibration electronics, the injector drivers and the injectors in a single package, the manufacturer will be better able to match the fuel rail to the principal command signals issued to the fuel rail from the engine management computer. In the embodiments of the invention that will be illustrated herein, the self-contained electronics are immersed in the liquid fuel within the fuel rail, and in comparison to prior designs which package the electronics with the engine management computer remote from the fuel rail assembly, this allows heat dissipated by the electronics, particularly heat from the drivers, to be rejected to the liquid fuel, and it also removes a source of electrical noise from the immediate vicinity of the engine management computer. The fuel rail assembly may also include associated sensors, such as a pressure sensor for sensing pressure of liquid fuel within the fuel rail assembly and a fuel mixture sensor for sensing the composition of the fuel, such as a methanol sensor for sensing the relative proportions of gasoline and methanol in the liquid fuel. Thus is it possible to fabricate a common fuel rail assembly that can be electronically customized and adapted to accommodate a multitude of varying uses.

Further features, advantages, and benefits of the invention, along with those already mentioned, will be seen in the ensuing description and claims, which are accompanied by drawings. The drawings disclose a presently preferred embodiment of the invention according to the best mode contemplated at the present time in carrying out the invention.

DESCRIPTION OF THE PREFERRED EMBODIMENT

Figure 1:
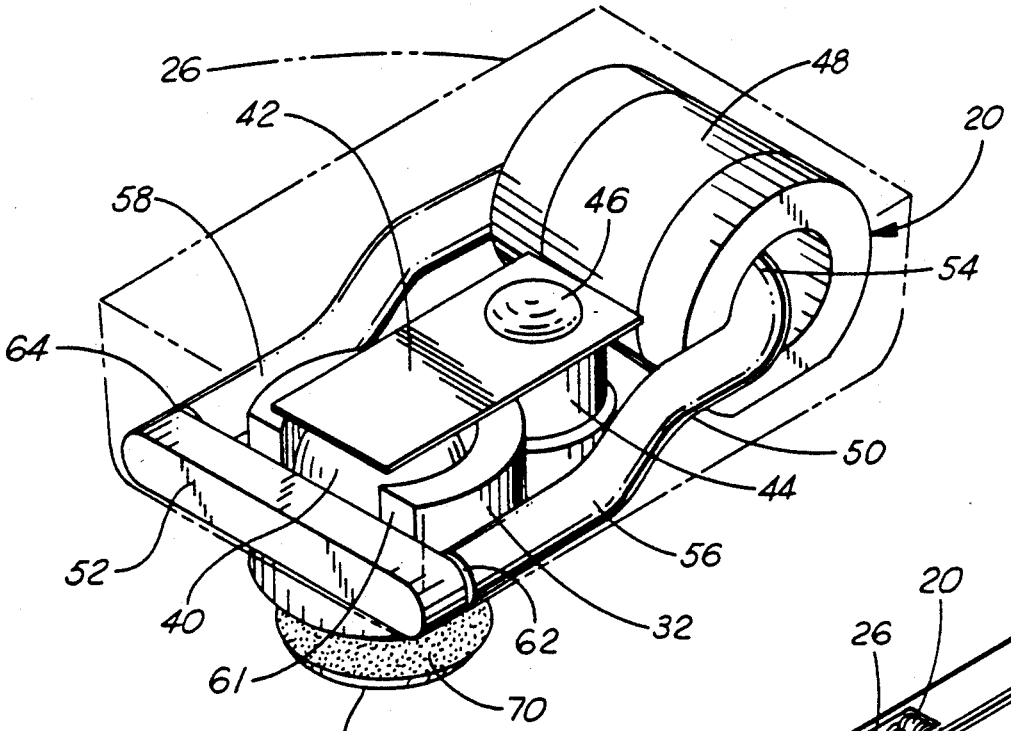
FIG. 1 is a perspective view illustrating the general organization and arrangement of a fuel injector used in a fuel rail assembly embodying principles of the invention.

FIGS. 1–7 disclose a fuel rail assembly 18 containing several fuel injectors 20 pursuant to the present invention. The fuel injectors are disposed on a carrier 22 that fits within a circular cylindrical walled tube 24, and there are four injectors for this particular example.

For each injector 20, carrier 22 comprises a somewhat rectangular-shaped well 26 which has a sidewall 28 and a bottom wall 30. Each injector comprises a seat member 32 that has a frustoconical seat 34 that funnels to a hole 36. Seat 34 and hole 36 share a co-axis 38 which is perpendicular to bottom wall 30, and wall 30 has a suitably-shaped hole allowing seat member 32 to fit therein in the manner illustrated. A sphere 40 is seated on seat 34, and all Figs. show the sphere concentric with axis 38 in closure of hole 36. The sphere is resiliently urged to such concentricity by an overlying flat spring blade 42 which is cantilever-mounted atop an upright post 44 on wall 30 aside seat member 32. All Figs. show blade 42 to be essentially parallel with wall 30. The cantilever mounting of the blade on the post is accomplished by means of a hole in the blade through which a close-fitting pin on the post passes and a head 46 on the pin which overlaps the margin of the hole in the blade to hold the corresponding end of the blade securely on the top of post 44. Alternately, post 44 could have a hole in its top, and the shank of a headed screw could be passed through the hole in the blade, and the screw tightened in the post hole so that the screw head holds the blade against the top of the post. Although the Figs. show the blade to be flat and essentially parallel with wall 38, the spring exerts a pre-load force on sphere 40 when the sphere is concentric with axis 38. This pre-load can be created by suitable shaping of the blade, by setting the relative elevations of the top of post 44 and the top of the sphere in a particular way, or by a combination of both.

The injector has a magnetic circuit that encircles sphere 40 and is composed of a solenoid coil 48, a stator 50, and an armature 52. As viewed in FIG. 3, the magnetic circuit may be considered to have a generally four-sided rectangular shape for fitting into well 26. Coil 48 and armature 52 form two opposite sides while the remaining two sides, which are opposite each other, are formed by portions of stator 50. Coil 48 is disposed in well 26 with its axis parallel to bottom wall 30 and spaced from axis 38. Wall 30 includes a hole for cradling coil 48. Stator 50 is generally U-shaped, comprising a base 54 that passes through coil 48 and parallel legs 56, 58 that extend from base 54 to form two opposite sides of the magnetic circuit. Legs 56, 58 contain bends that provide for the transition from the level of coil 48 to the level of sphere 40. Armature 52 is in the form of a bar that is disposed along side sphere 40 and operated by the magnetic circuit to act on the sphere at essentially the midpoint of the bar indicated by the reference numeral 60. Seat member 32 contains a suitably shaped notch 61 that allows the armature to act on the sphere. In the condition portrayed in the Figs., which is for the solenoid coil not energized, the opposite ends of the bar are spaced from the distal ends of legs 56, 58 by generally equal working gaps 62, 64, and the midpoint of the armature is in contact with the sphere at the end of a particular radial of the sphere. When the solenoid coil is energized, the magnetic flux that is generated in the magnetic circuit operates to reduce working gaps 62, 64 by attracting armature 52 toward the ends of the stator's legs 56, 58. This causes armature 52 to be moved bodily predominantly along the direction of an imaginary line that intersects axis 38 and that when viewed along axis 38 is essentially coincident with the radius of the sphere whose end is contacted by the midpoint of the armature. The cooperative effect of the motion of armature 52, of the resilience of spring blade 42, and of the angle of seat 34 is such that the sphere is moved from concentricity with axis 38 to eccentricity with axis 38 with the result that hole 36 opens. Sphere 40 is actually caused to roll slightly up seat 34 in the direction toward post 44. When energization of the solenoid coil terminates, the magnetic attractive force that stator 50 had been exerting on the armature ceases, and this enables the resiliency of spring blade 42 to return the sphere to concentricity with axis 38 and resulting closure of hole 36.

Hole 36 is surrounded by the tip end, or nozzle, 68 of the fuel injector at which fuel is injected into the engine. An O-ring seal 70 is seated in a groove extending around the sidewall of the injector tip end. Electric lead wires 72 from the injectors are disposed in channels 74 in carrier 22 and extend to a connector 76 at the near end of the carrier as viewed in FIG. 5. The solenoid coils, stators, and seat members are secured within the carrier wells by any suitable means of securement, and a cover 78 containing suitable windows each providing an inlet for each fuel injector fits over the carrier to entrap the lead wires in the channels. The cover may comprise certain means of confinement for certain of the components of the fuel injectors, such as projections 79 (FIG. 2) that serve to confine armatures 52 and to limit the extent to which the spring blades 42 can be flexed away from seat members 32.

The combination of the carrier, the injectors, and the cover forms a sub-assembly that is assembled into tube 24 by insertion through one end of the tube. As perhaps best seen in FIG. 6, the sub-assembly has an envelope that is smaller than the main longitudinal hole 81 in tube 24. The sub-assembly is inserted into the tube to align the injector tip ends 68 with corresponding circular holes 82 through the wall of the tube. The sub-assembly is then displaced radially to pass the tip ends into holes 82 so that O-rings 70 seal between the tip ends and the holes in fluid-tight manner. A keeper 84 is then inserted via the same open end of the tube into the space 86 (FIG. 7) that exists between the sub-assembly and the semi-circumference of the tube wall that is generally opposite holes 82. Keeper 84 is illustrated as a length of angled metal that may have a certain resiliency for resiliently fitting between the sub-assembly and the tube wall in the manner portrayed. The bend of keeper 84 bears against the inside of the wall of tube 24 diametrically opposite holes 82 and the keeper's two sides extend from the bend to capture the sub-assembly in the assembled position of FIG. 7.

In use pressurized liquid fuel is introduced into tube 24 via a suitable inlet so that the fuel injectors are essentially completely immersed in fuel. The fuel rail may contain a pressure regulator and also have a return outlet for return fuel when the rail is part of a recirculating fuel system. Neither an inlet fitting, a return outlet fitting, nor a pressure regulator are specifically shown in the drawing Figs., nor are the provisions that would be required for enclosing the tube ends if the inlet and/or outlet were to be located in other than such ends. The particular configuration for any specific fuel rail embodying the principles of the present invention will depend on the specific engine which the fuel rail must fit. In use, connector 76 serves to connect the fuel injectors to the usual engine management computer so that the injectors are operated at the proper times and for the proper durations. The energization of an injector solenoid will open the injector to cause an injection of fuel from the interior of the tube to be emitted at the injector tip end through hole 36. Metering of injected fuel can be performed by a thin orifice disc (not shown) mounted on the injector tip end in covering relation to the outlet of hole 36. The injection terminates with the termination of solenoid energization.

Figure 8:
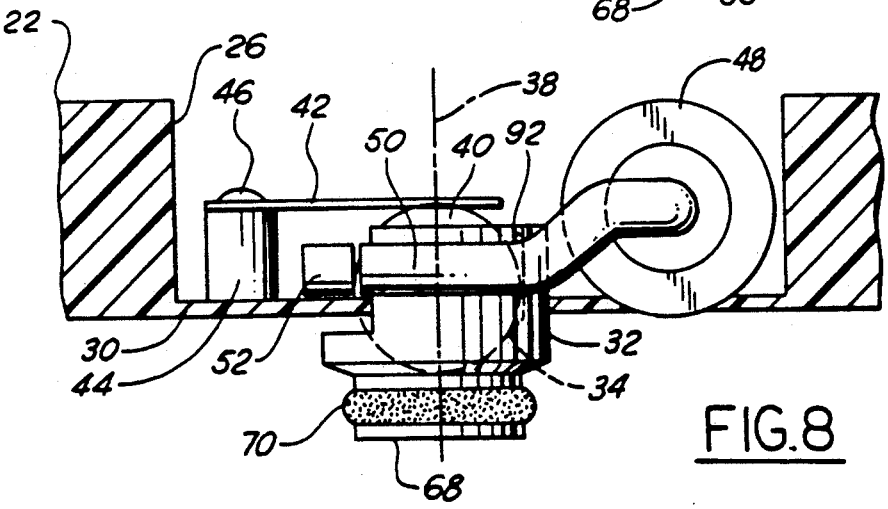
FIG. 8 is an elevational view of another embodiment of fuel injector.

FIG. 8 presents an alternate embodiment of fuel injector using the same earlier reference numerals to designate like parts. The essential difference is that the injector of FIG. 8 places the cantilever mounting of spring blade 42 on the opposite side of seat 34 from solenoid coil 48. This allows the magnetic circuit path to be shortened since the solenoid coil can be placed closer to the seat and the legs of the stator can be shorter.

Figure 9:
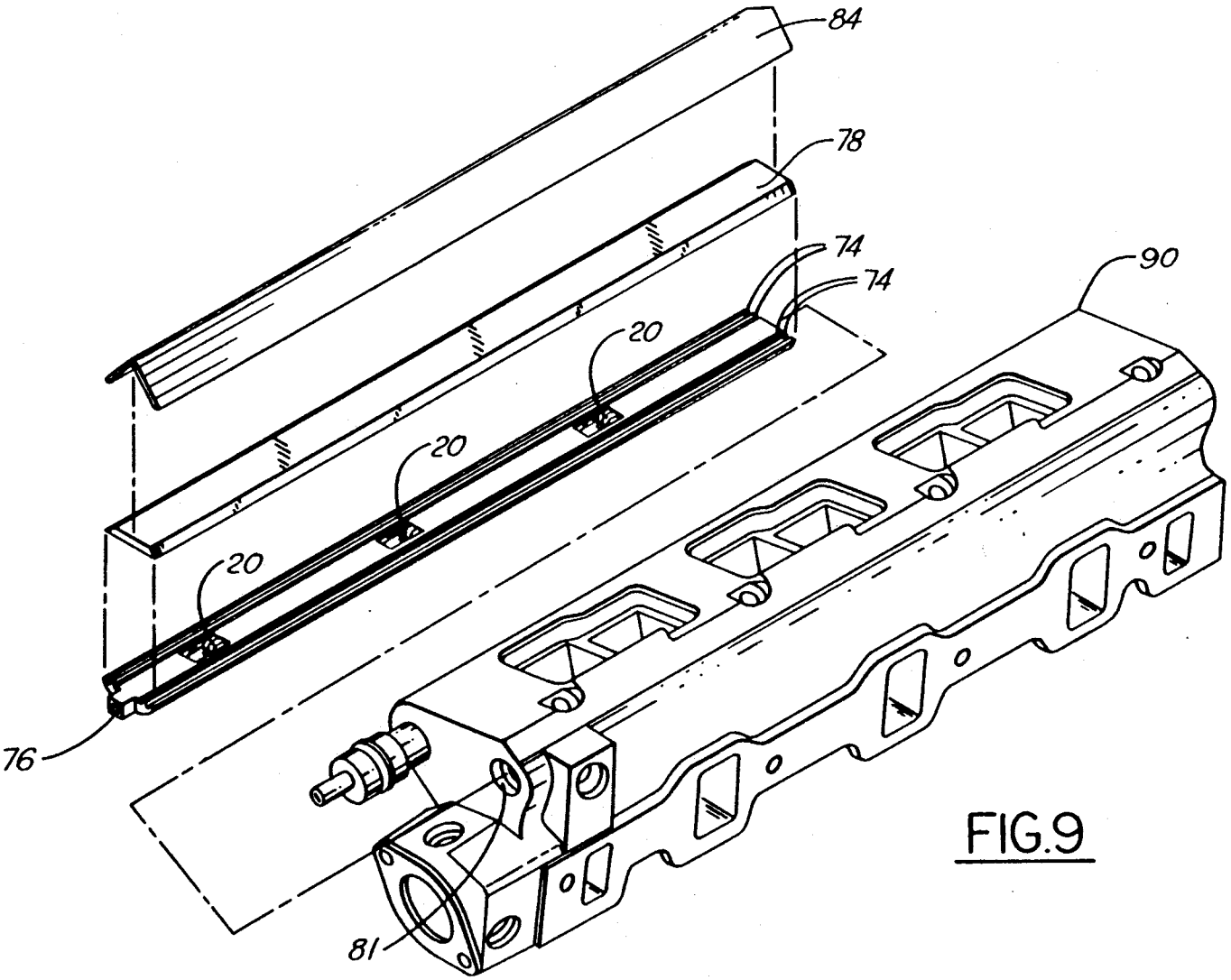
FIG. 9 is an exploded perspective view of an embodiment in which the fuel rail is integrated in an engine manifold.

FIG. 9 presents an alternate embodiment of fuel rail using the same earlier reference numerals to designate like parts. FIG. 9 shows the tube hole 81 to be an integral part of an engine manifold 90 into which the sub-assembly composed of the carrier, the fuel injectors, and the cover is inserted. The keeper 84 is also inserted into hole 81 to capture the sub-assembly in assembled position in the same manner as in FIG. 7.

Figures 10, 11:
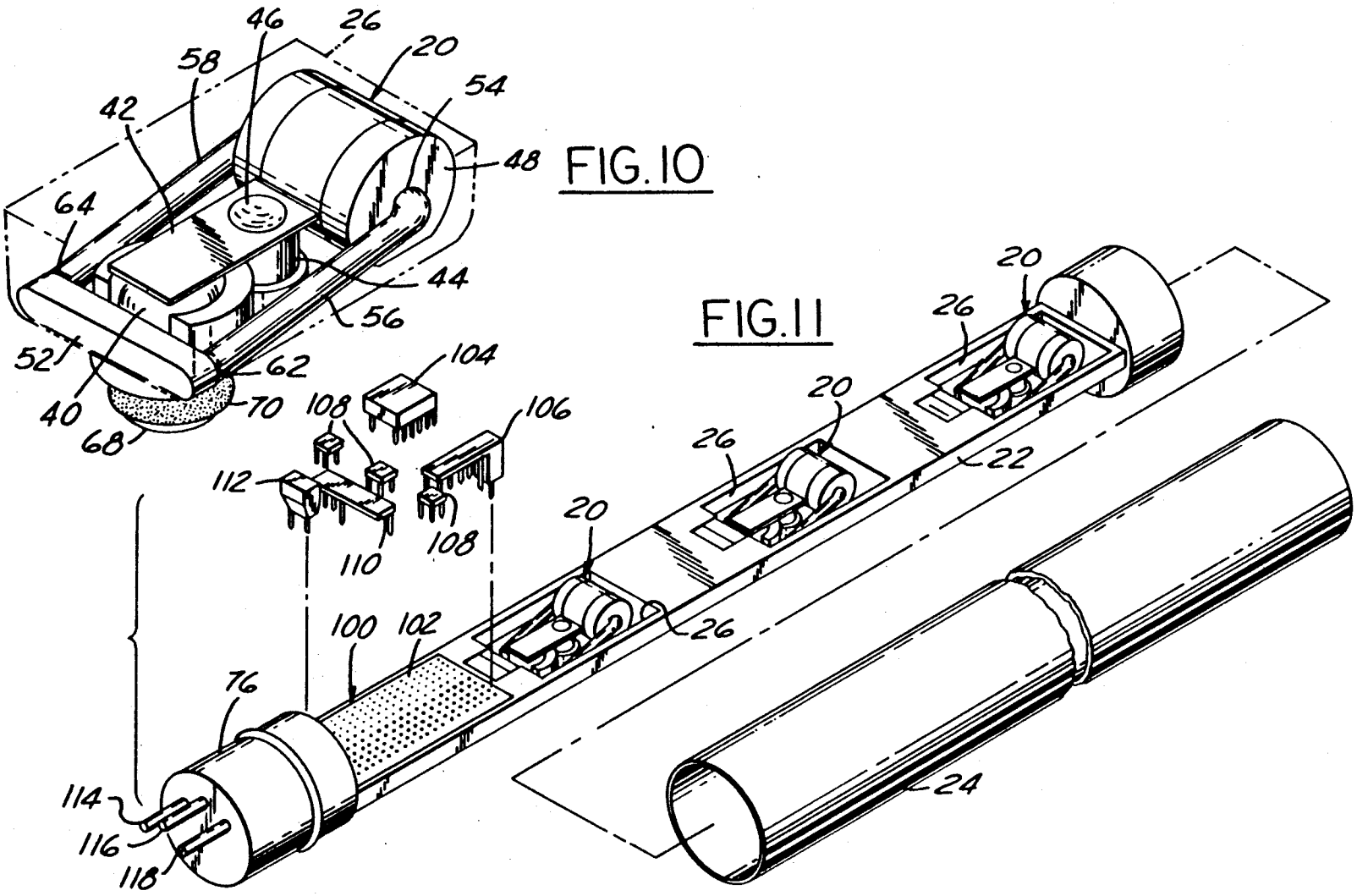
FIG. 10 is perspective view of a modified form of fuel injector.
FIG. 11 is an exploded perspective view, with portions broken away for illustrative purposes, of another embodiment of fuel rail assembly according to the invention.

FIG. 10 shows a fuel injector 20 which is like that of FIG. 1 with the exception of the stator and coil. The same reference numbers that were used in FIG. 1 designate like parts in FIG. 10. The differences between FIGS. 1 and 10 are that coil 48 is wound directly onto base 54 of stator 50 and that legs 56, 58 of stator 50 are straight. The distal end faces of the legs are not perpendicular to the legs' lengths so that they remain parallel to the juxtaposed surface of armature 52.

Figure 5:
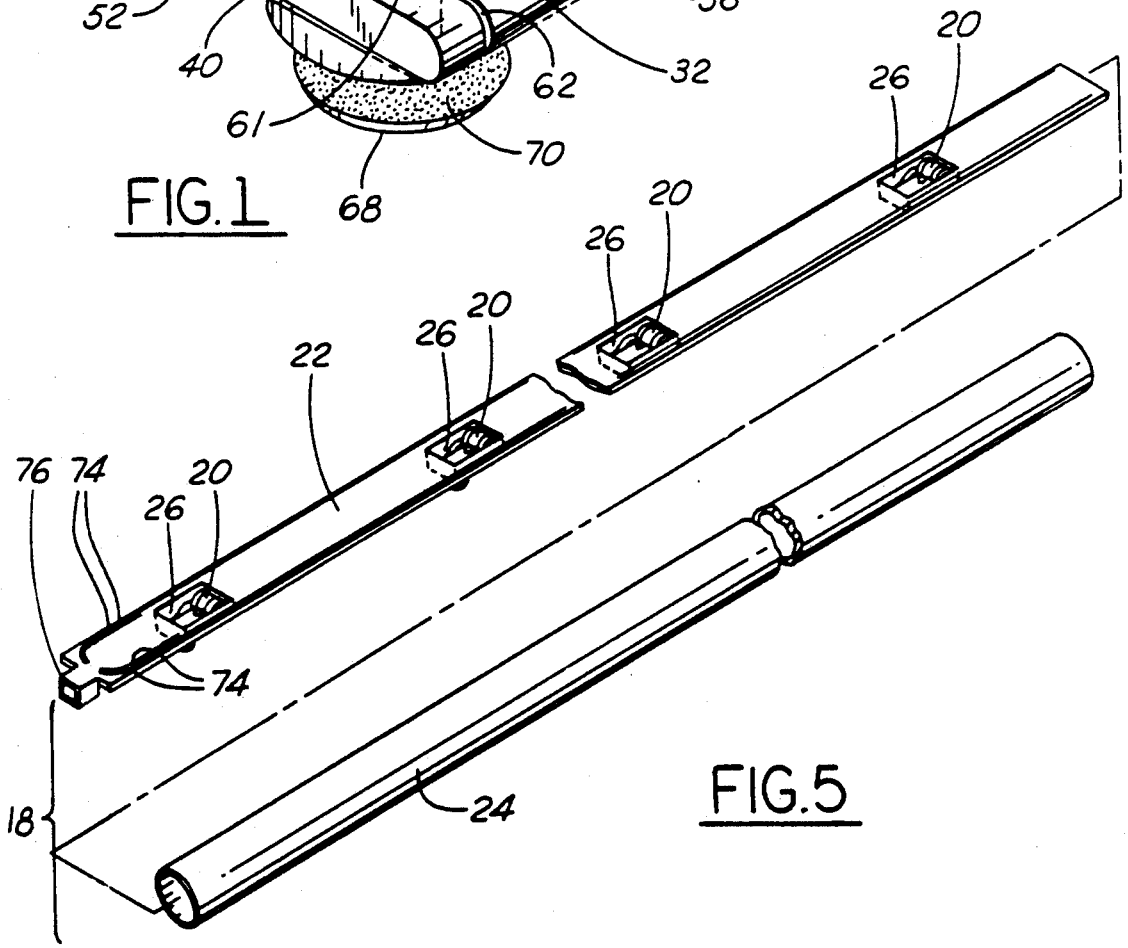
FIG. 5 is an exploded perspective view of certain portions of a fuel rail assembly that embodies principles of the invention and contains fuel injectors like that of FIGS. 1–4.
Figure 2:
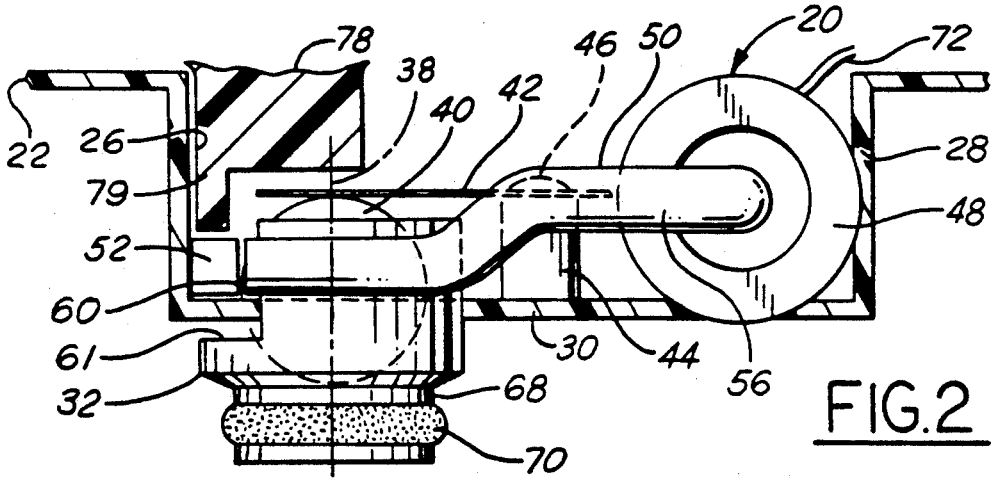
FIG. 2 is a side elevational view of the fuel injector of FIG. 1 from one direction.

FIG. 11 shows another fuel rail assembly, which is similar to that of FIG. 5, and like numerals are used to designate corresponding parts in both FIGS. FIG. 11 shows three of the fuel injectors of FIG. 10 disposed in respective wells, or cavities, 26 of a carrier 22. Also disposed on carrier 22 between the set of fuel injectors 20 and connector 76 is an electronic circuit board assembly 100 which comprises a board 102 and several electronic devices, shown in the FIG. in exploded form for illustrative purposes. The several electronic devices are mounted on board 102 and interconnected by circuit paths on the board to provide the fuel rail assembly with self-contained electronics between connector 76 and fuel injectors 20.

The several electronic devices are a microprocessor 104 with associated crystal 106, three fuel injector drivers 108, a PROM 110, and a voltage regulator 112. Connector 76 comprises three terminals 114, 116, 118. DC electric power (+V volts referenced to Ground) is delivered through a first (+V) and a second (Ground) of these terminals to the self-contained electronics, and voltage regulator 112 converts the delivered power to regulated DC level for microprocessor 104 and drivers 108. Principal command signals (referenced to ground) delivered by the engine management computer (not shown) to the fuel rail assembly pass through the third terminal (Signal) to a serial input port of microprocessor 104. The microprocessor output ports are connected to inputs of the respective drivers via the board, and the drivers' outputs are connected by respective conductors extending from the board along the carrier to the respective fuel injectors. The microprocessor acts on the principal command signals to produce corresponding operation of the fuel injectors. In other words, the principal command signals received by the self-contained electronics represent the pulse widths of signals that should cause the fuel injectors to deliver corresponding injections of fuel into their respective portions of the engine's induction system. Because of the electronic calibration that has been performed on the fuel rail assembly during its manufacturing process (such procedure to be subsequently explained), such correspondence is assured despite the presence of certain differences in the operating characteristics of different components.

For example, each fuel injector may have a slightly different dynamic flow characteristic due to manufacturing tolerances, and in such case each fuel injector will inject a slightly different amount of fuel from the others for identical command signals applied to them. With the ability to perform calibration of the self-contained electronics in accordance with one aspect of this invention, it becomes possible to compensate for these differences so that the fuel injections will more closely match one another. While it is typical practice to secure such closely matching correspondence between all injectors, the circuitry could, if desired, be constructed and arranged to provide for any particular fuel injector to be dynamically calibrated to any particular dynamic flow.

The dynamic flow calibration is performed in a test and calibration fixture (not shown) by a test and calibration machine (not shown) after the carrier/fuel injector/electronics sub-assembly has been assembled into tube 24, such as in the manner described for the earlier embodiment. Pressurized liquid, which may be fuel or another fluid whose flow characteristics bear a known relationship to those of fuel, is supplied to fill the interior of the fixtured fuel rail assembly. The fuel injectors are operated by signals delivered through connector 76 and the fuel injections are measured. For example, signals can be applied at predetermined frequencies and pulse widths which should cause the injectors to deliver certain quantities of fuel. The actual quantities which the fuel injectors deliver in response to these signals are measured using a known "gravimetric" or volume means. If a fuel injector does not produce the intended volume, the difference is computed, and an error number, either positive or negative, is derived from that difference and entered into prom 110 by conventional prom programming techniques to create a correction factor within the fuel rail assembly's self-contained electronics. Microprocessor 104 will act upon this correction factor when it receives a principal command signal via connector 76 from the engine management computer and in consequence cause the corresponding fuel injector to deliver a quantity of fuel that agrees with that commanded by the principal command signal. A more detailed description of a means by which this can be done is described in the co-pending, commonly assigned patent application of Charles R. Cook, Jr. Ser. No. 07/740,785, filed Aug. 6, 1991.

If the fuel rail assembly also includes a self-contained pressure sensor and/or a self-contained fuel mixture sensor, as described earlier, the outputs of these sensors can be used as inputs to the self-contained electronics, and the self-contained electronics can be constructed and arranged to act upon the sensor signals in an analogous manner to that of the dynamic flow calibration so that a corrected signal is applied to each injector to cause the injector to deliver the quantity of fuel commanded by the principal command signal received by the fuel rail assembly from the engine management computer that will make the injections substantially insensitive to fluctuations in fuel pressure and/or fuel mixture composition. The sensors can be advantageously mounted on the carrier and directly connected into the circuit board assembly.

Figure 12:
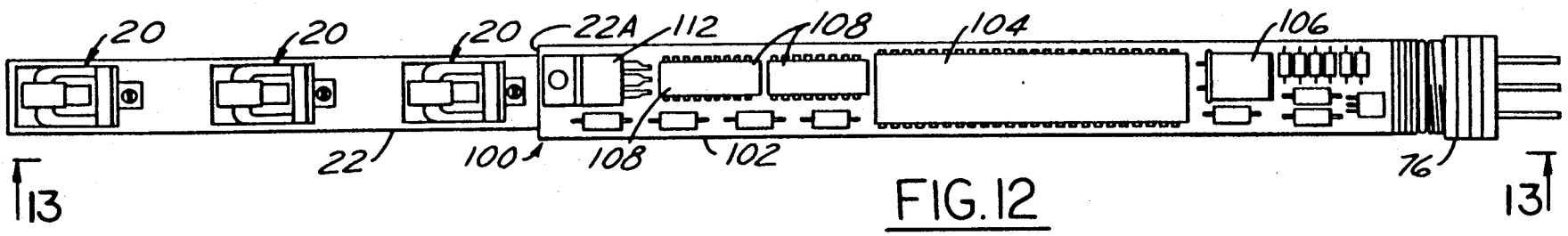
FIG. 12 is a top plan view of another embodiment of carrier used in the inventive fuel rail assembly.
Figure 13:
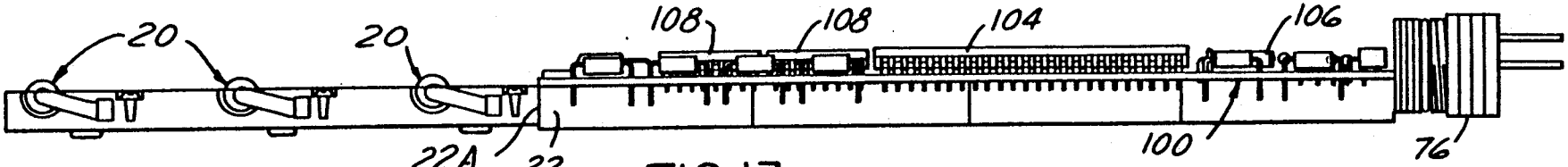
FIG. 13 is a view in the direction of arrows 13—13 in FIG. 12.
Figure 14:
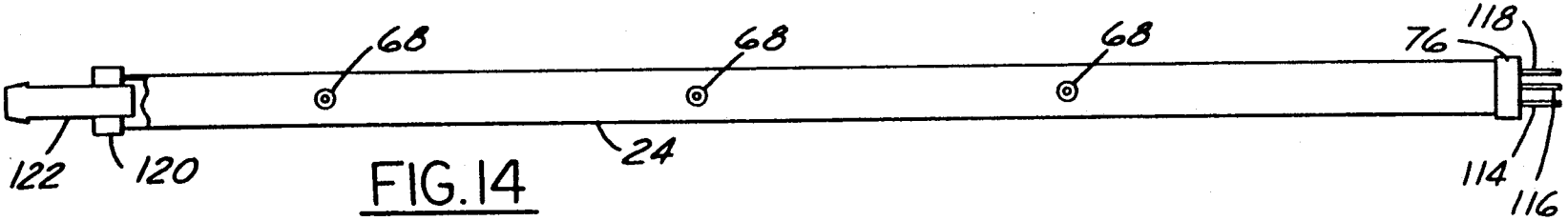
FIG. 14 is a bottom plan view of a fuel rail assembly containing the carrier of FIGS. 12 and 13, but having a portion broken away for illustrative purposes.

FIGS. 12–14 illustrate another embodiment of fuel rail assembly which has several fuel injectors 20 and a circuit board assembly 100 mounted on a carrier 22 that is disposed within a tube 24. The fuel injectors shown in FIGS. 12 and 13 are like the one of FIG. 10 with the exception that the flat spring blade 42 of each is cantilever-mounted a la FIG. 8 on the opposite side of its sphere 40 from the position shown in FIG. 10. The circuit board assembly contains the same basic devices described above, and is shown to also include some associated devices including a zener diode, capacitors, and resistors. Connector 76 is separably mounted on the circuit board assembly and forms a closure for one end of tube 24 after the carrier/fuel injector/electronic circuit board sub-assembly has been inserted into the tube. Like its counterpart in the preceding embodiment, connector 76 has three terminals 112, 114, 116 which provide the same connections as in the preceding embodiment. Further detail relating to connector 76 of the FIGS. 12–14 embodiment can be found in co-pending, commonly assigned application of Robert A. McArthur Ser. No. 07/825,458, filed Jan. 22, 1992 as a continuation of Ser. No. 07/740,693, filed Aug. 6, 1991.

The end of tube 24 opposite connector 76 is closed by a closure 120 which contains a through-nipple 122 via which liquid fuel is introduced into the interior of the fuel rail assembly. The fuel rail assembly configuration of FIG. 14 is intended for use in a "dead-head" type system where the fuel pressure in the rail is controlled by the control of an electric motor driven pump, and a mechanical pressure regulator with a fuel return line for returning excess fuel to tank is not used.

Figure 15:
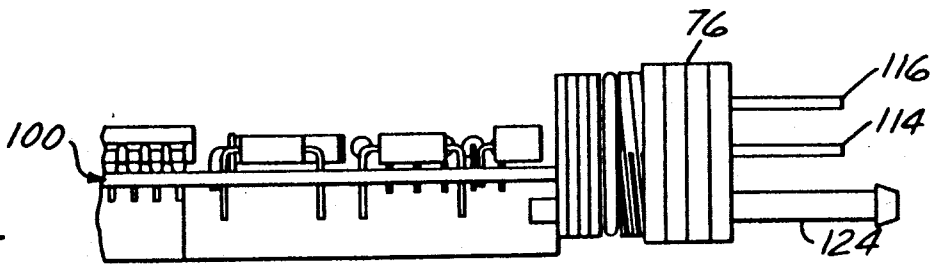
FIG. 15 is an enlarged fragmentary view in the same direction as the view of FIG. 13, but illustrating a modified form.

If a fuel rail assembly like that of FIG. 14 is used in a system having such a mechanical fuel pressure regulator and a return line, connector 76 may be modified, as shown in FIG. 15, to include a through-nipple 124 through which excess fuel from such a fuel rail mounted pressure regulator is returned to tank. Although not explicitly depicted in FIG. 15, it is understood that the interior end of through-nipple 124 is fluid coupled by a conduit to the return port of the pressure regulator, and that the through-nipple is in no way in direct communication with the pressurized fuel in the rail.

The carrier that has been illustrated in FIGS. 11–15 has a generally semi-circular transverse cross sectional shape. It is on a radius smaller than that of the I.D. of tube 24 so that after the carrier has been inserted into the tube, it can be moved transversely to seat the fuel injector nozzles 68 in the holes in the wall of the tube. Such assembly is performed before connector 76 is assembled onto the circuit board assembly. It is only after the carrier/fuel injector/circuit board sub-assembly has been so assembled into the tube that connector 76 is assembled to close the tube end and simultaneously make electrical circuit connections with the circuit board, as explained in the co-pending, commonly assigned application of Robert A. McArthur. In the embodiment of FIGS. 12–15, carrier 22 has a shoulder 22A which divides the carrier into a smaller radiused section to the shoulder's left in FIGS. 12 and 13, and a larger radiused section to the right. The tube 24 of FIG. 14 into which the carrier 22 of FIGS. 12–13 is inserted has a corresponding internal shoulder so that in the completed fuel rail assembly each approximately semi-circularly curved section will fit closely to a corresponding internal section of the tube 24.

Figure 3:
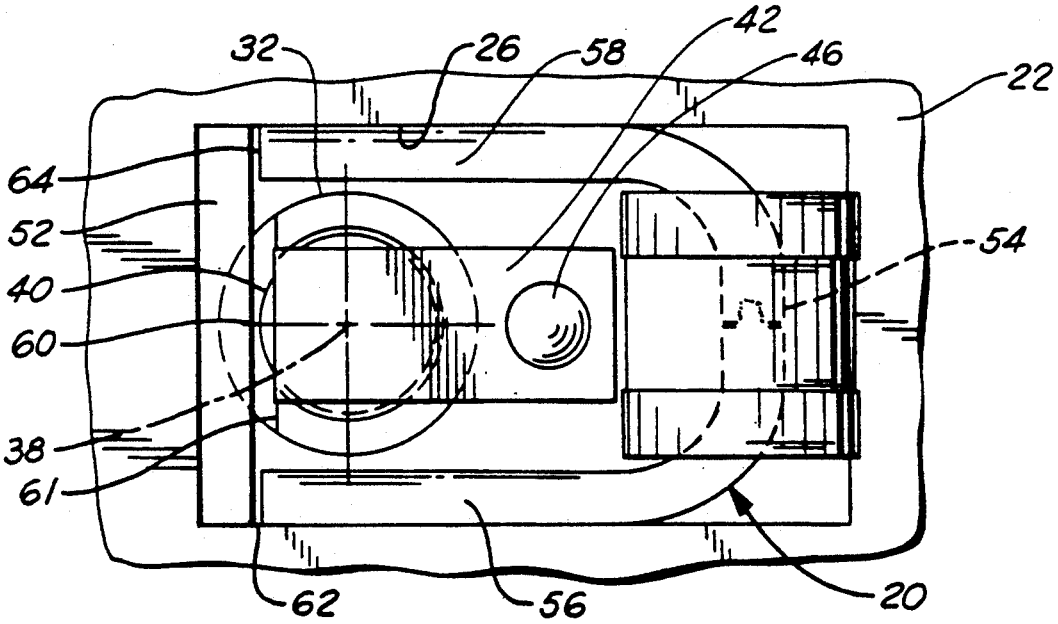
FIG. 3 is a top view of FIG. 2.
Figure 4:
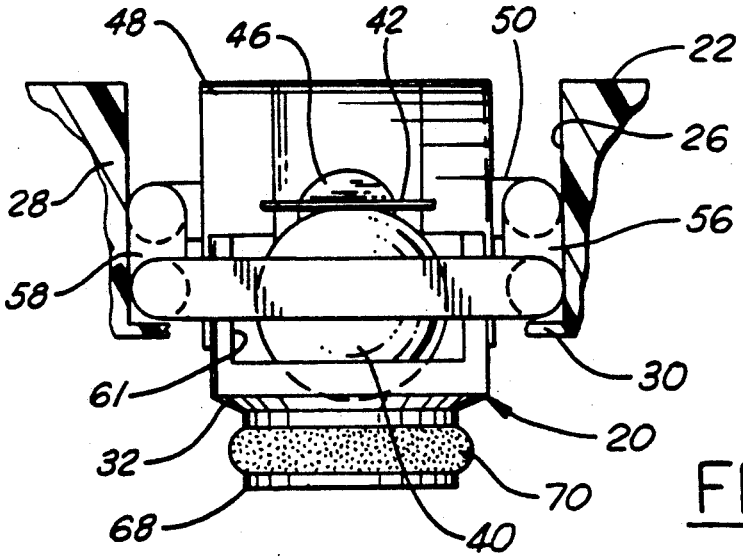
FIG. 4 is a left side view of FIG. 2.
Figure 6:
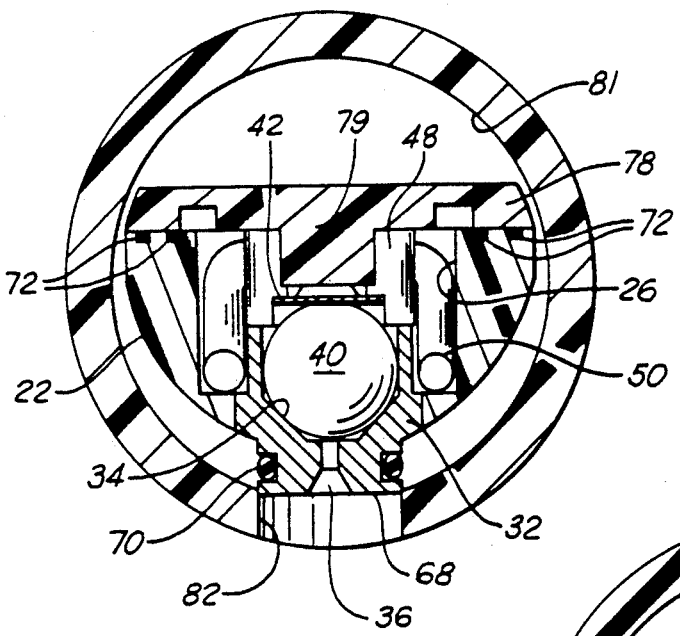
FIG. 6 is a transverse cross sectional view through the fuel rail assembly of FIG. 5 on a different scale and illustrates further detail, including a particular step in the process of fabricating the fuel rail assembly.
Figure 7:
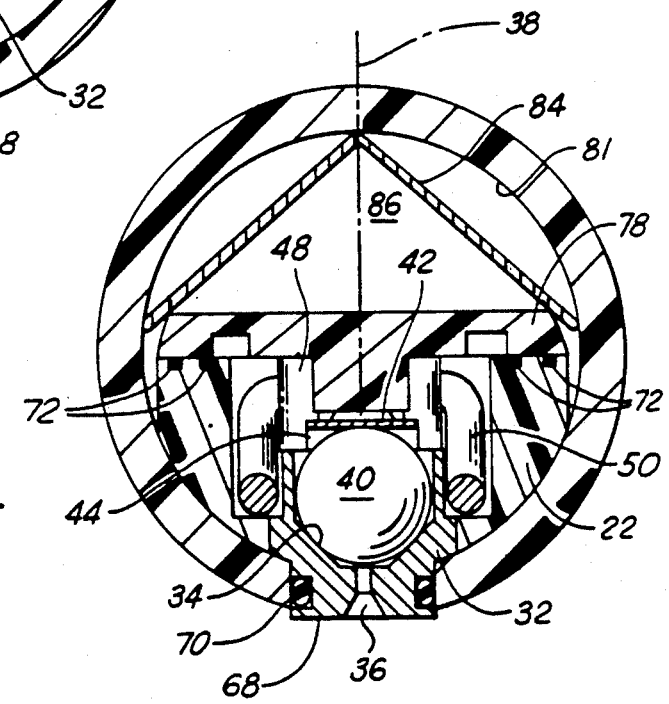
FIG. 7 is a view similar to FIG. 6 illustrating the condition after completion of the step being portrayed by FIG. 6.

The materials, surface finishes, hardnesses, elasticities, etc. of the various parts should be chosen to provide acceptable performance and longevity in their particular operating environment. So that seat member 32 does not shunt flux from the magnetic circuit, it is fabricated from non-magnetically-permeable material, such as a suitable stainless steel. It is contemplated that certain plastics may be useful for certain parts. For example, carrier 22, tube 24, and cover 78 can be made from plastics that are inert when placed in a wet fuel environment, and of course all materials that are exposed to fuel must be inert to the particular fuel composition or compositions that are used. It is contemplated that sphere 40 can itself be a suitable plastic. FIG. 3 illustrates a particular construction for stator 50 that may be used to advantage in fabricating the fuel injector's magnetic circuit. Rather than being a one-piece element, the stator is constructed from two separate pieces, each of which comprises the entirety of one of the stator's legs and a fraction of its base. One piece contains a threaded hole in the end of its base portion and the other piece contains a threaded shank in the end of its base portion. The two pieces are joined by screwing the threaded shank into the threaded hole after the respective base portions have been inserted into the solenoid coil.

The magnetic circuit is preferably constructed such that the working gaps do not close to an extent that allows full surface-to-surface contact of the armature with the ends of the stator legs. This can be accomplished by designing seat member 32, sphere 40, and the magnet circuit such that when the sphere is displaced from concentricity with axis 38, its travel will be arrested by abutment with an axial wall 92 (FIG. 8) of seat member 32 before the working gaps have fully closed. Axial wall 32 extends away from seat 34 parallel to axis 38. It is also possible to place a non-magnetic coating over the ends of the stator and the armature. Because the armature experiences relatively small displacement as it is operated, an equivalent armature could comprise a pivotal mounting at one end so that the armature travel is executed over a small arc. This will still result in essentially the same action on the sphere, i.e. motion that is directed essentially toward axis along the radial of the sphere that is contacted by the middle of the armature.

While a presently preferred embodiment has been illustrated and described, it should be understood that principles of the invention may be practiced in other equivalent ways.

What is claimed is:

1. In a fuel rail assembly for multi-point injection of liquid fuel into an internal combustion engine via electrically operated fuel injectors carried by a fuel rail member which has a main fuel rail hole via which a liquid fuel supply is presented to the injectors carried by the fuel rail member, the improvement which comprises a fuel injector carrier which carries said fuel injectors and disposes said fuel injectors within said main fuel rail hole so that said fuel injectors are immersed in said liquid fuel supply, nozzle-receiving means in said fuel rail member for receiving nozzles of said fuel injectors in a sealed manner so that fuel can be injected from said nozzles without fuel from said liquid fuel supply leaking through said nozzle-receiving means, and electric circuit means from said injectors to terminations that are at the exterior of said fuel rail.

2. The improvement set forth in claim in which said electric circuit means comprises electrical conductors extending along said carrier to a connector containing said terminations.

3. The improvement set forth in claim 1 including a cover that overlies said carrier, said cover including means to capture certain parts of each fuel injector within a confined space.

4. The improvement set forth in claim 3 in which said means to capture certain parts of each fuel injector within a confined space comprises means to limit the extent to which a resilient spring blade of each fuel injector can be resiliently flexed and to confine an armature of each fuel injector.

5. The improvement set forth in claim including keeper means that acts between the wall of said hole and said carrier to keep said nozzles received in said nozzle-receiving means.

6. The improvement set forth in claim 5 in which said keeper means comprises a keeper in the form of an elongate angle having a bend disposed against the wall of said hole diametrically opposite said nozzle-receiving means and sides which extend from said bend toward said carrier.

7. The improvement set forth in claim 1 in which said electric circuit means comprises an electronic circuit board assembly disposed on said carrier within said hole, said electronic circuit board assembly comprises a circuit board on which are mounted a plurality of electronic devices forming electronic circuitry operatively connected between said fuel injectors and said terminations for operating said fuel injectors by means of electric power and command signals transmitted through said terminations to said electronic circuitry.

8. The improvement set forth in claim 7 in which said electronic devices include a microprocessor having input port means receiving such command signals and output port means at which signals derived from such received command signals are given, and driver circuit means having inputs connected via said circuit board with said output port means and outputs connected to said fuel injectors.

9. The improvement set forth in claim 8 in which there are three terminations, two of which deliver DC electric power to said electronic circuitry, and the other of which delivers said command signals to said microprocessor.

10. The improvement set forth in claim 8 in which said electronic devices include a prom which is programmed with correction data that is used by the microprocessor when acting upon the command signals to cause the actual fuel injection deliveries by the fuel injectors to more closely correspond to the command signals than would be the case without the microprocessor acting on the correction data.

11. The improvement set forth in claim 10 including a sensor that senses a characteristic of the fuel in the fuel rail and supplies to said electronic circuitry data that is used by said electronic circuitry when acting upon the command signals to cause the actual fuel injection deliveries by the fuel injectors to be rendered substantially insensitive to variations in said fuel characteristic.

12. The improvement set forth in claim 11 in which said fuel characteristic is at least one of fuel pressure and fuel composition.

13. The improvement set forth in claim 12 in which said sensor is mounted on said carrier.

14. The improvement set forth in claim 7 in which there are only three terminations, two of which deliver DC electric power to said electronic circuitry, and the other of which delivers said command signals to said electronic circuitry.

15. The method of making a fuel rail which comprises mounting a plurality of electrically operated fuel injectors at spaced apart locations along the length of an elongate carrier, inserting said injector-containing carrier endwise into an open end of a hole in a member that has a plurality of spaced apart nozzle-receiving means for receiving nozzles of said carrier-mounted fuel injectors to register said nozzles with said nozzle receiving means, and then transversely displacing said carrier to dispose said nozzles in said nozzle-receiving means.

16. The method set forth in claim 15 including inserting an elongate keeper endwise into said hole to retain said carrier in position that keeps said nozzles in said nozzle-receiving means.

17. The method set forth in claim 15 including the step of performing a dynamic flow calibration of the fuel injectors by operating the fuel rail under predetermined operating conditions, measuring the actual injections from the fuel injectors, calculating the differences between the measured fuel injections and the fuel injections that are expected to occur under said predetermined operating conditions, and programming those differences into electric circuitry contained on a circuit board assembly that is mounted on said carrier within the fuel rail so that subsequent operation of the fuel injectors will be conducted with the use of such programmed differences.

* * * * *